US011651882B2

(12) United States Patent
Imboden et al.

(10) Patent No.: US 11,651,882 B2
(45) Date of Patent: May 16, 2023

(54) SOLENOID MICROACTUATOR WITH MAGNETIC RETRACTION

(71) Applicant: The Swatch Group Research and Development Ltd, Marin (CH)

(72) Inventors: Matthias Imboden, St-Blaise (CH); Cédric Nicolas, Neuchatel (CH); Nicolas Livat, Cressier (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 17/486,398

(22) Filed: Sep. 27, 2021

(65) Prior Publication Data

US 2022/0115170 A1 Apr. 14, 2022

(30) Foreign Application Priority Data

Oct. 8, 2020 (EP) ..... 20200735

(51) Int. Cl.

| | |
|---|---|
| ***H01F 7/00*** | (2006.01) |
| ***H01F 7/16*** | (2006.01) |
| ***G04C 1/02*** | (2006.01) |
| ***H01F 7/08*** | (2006.01) |

(52) U.S. Cl.

CPC ..... *H01F 7/1615* (2013.01); *G04C 1/028* (2013.01); *H01F 7/081* (2013.01); *H01F 2007/086* (2013.01)

(58) Field of Classification Search

CPC .. H01F 7/1615; H01F 7/081; H01F 2007/086; H01F 7/122; H01F 7/1646; G04C 1/028; G04G 21/00

USPC ..... 335/329

See application file for complete search history.

(56) References Cited

U.S. PATENT DOCUMENTS

| | | | | |
|---|---|---|---|---|
| 3,248,499 | A * | 4/1966 | Young | H01F 7/1646 335/182 |
| 3,634,735 | A * | 1/1972 | Komatsu | H01F 7/1646 361/194 |
| 4,004,258 | A * | 1/1977 | Arnold | F16K 31/082 335/154 |
| 4,533,890 | A | 8/1985 | Patel | |
| 5,010,911 | A * | 4/1991 | Grant | F16K 31/082 335/238 |

(Continued)

FOREIGN PATENT DOCUMENTS

| | | |
|---|---|---|
| FR | 2 884 349 A1 | 10/2006 |
| WO | 2020/084220 A1 | 4/2020 |

OTHER PUBLICATIONS

European Search Report for EP 20 20 0735 dated Mar. 8, 2021.

*Primary Examiner* — Shawki S Ismail
*Assistant Examiner* — Lisa N Homza
(74) *Attorney, Agent, or Firm* — Sughrue Mion, PLLC

(57) ABSTRACT

A magnetic microactuator (100) including a coil (6; 61; 62) controlling the axial movement of a sliding block (30) including at least one permanent magnet (2) joined or aligned with a ferromagnetic or magnetised rear arbor (42) and guiding the field lines of the magnetic field of revolution in the axial direction (D) through the coil (6; 61; 62) wherein circulates the sliding block (30), up to a rear end (43) of said rear arbor (42) that tends to cooperate by magnetic attraction with at least one first ferromagnetic restoration element (8), located in the vicinity of a rear face (25) of the structure (20) of the microactuator (100), in order to bring said sliding block (30) back into a rear end-of-travel position when no coil (6; 61; 62) is powered.

23 Claims, 6 Drawing Sheets

(56) References Cited

U.S. PATENT DOCUMENTS 5,877,569 A * 3/1999 Heinrich ..... H02K 23/66 335/250
6,639,496 B1 * 10/2003 van Namen ..... H01F 7/1615 335/229
8,842,355 B2 * 9/2014 Lipton ..... H01L 41/0533 359/233
9,375,202 B2 * 6/2016 Swain ..... A61B 1/041
2002/0153982 A1 * 10/2002 Jones ..... H01F 7/122 335/220
2002/0158727 A1 * 10/2002 Namen ..... H01F 7/1615 335/78
2005/0024174 A1 * 2/2005 Kolb ..... H01F 7/1615 335/220
2005/0052265 A1 * 3/2005 Vladimirescu ..... H01F 7/1615 335/229
2006/0023390 A1 * 2/2006 Spurr ..... H01H 51/22 361/160
2008/0284261 A1 11/2008 Andrieux et al.
2012/0175974 A1 * 7/2012 Robertson ..... H01F 7/1646 310/12.26
2012/0306295 A1 * 12/2012 Kirstein ..... H02K 33/16 310/15
2013/0113582 A1 * 5/2013 Schiepp ..... F01L 13/0036 335/228
2013/0241680 A1 * 9/2013 Hanchett, Jr. ..... H01F 7/1872 335/234
2013/0328649 A1 * 12/2013 Robertson ..... H01F 7/1615 335/234
2013/0328650 A1 * 12/2013 Robertson ..... H01F 7/1646 335/234
2015/0279538 A1 * 10/2015 Toda ..... F16H 61/0009 335/255
2016/0049231 A1 * 2/2016 Hanchett, Jr. ..... H01F 7/16 361/208
2016/0172137 A1 * 6/2016 Liang ..... H01H 50/36 335/179
2017/0256349 A1 * 9/2017 Connell ..... H01F 7/1615

* cited by examiner

SOLENOID MICROACTUATOR WITH MAGNETIC RETRACTION

CROSS REFERENCE TO RELATED APPLICATIONS

This application is a Non-Provisional application, claiming priority based on European Patent Application No. 20200735.7 filed Oct. 8, 2020.

FIELD OF THE INVENTION

The invention relates to a magnetic microactuator including at least one structure containing at least one coil arranged to exert, in a powered position, an axial thrust force on a sliding block, included in said microactuator, in an axial direction in a first direction, up to a front end-of-travel position corresponding to an abutment bearing between a first bearing surface of said structure and a first abutment surface of said sliding block wherein front end-of-travel position a front arbor, that includes said sliding block, is protruding from a front face of said structure, and, when no said coil is powered said sliding block is moveable in said axial direction in a second direction opposite to said first direction, and is brought back by purely magnetic means to a rear end-of-travel position corresponding to the abutment bearing between a second bearing surface of said structure and a second abutment surface of said sliding block.

The invention also relates to a printed circuit including at least one such microactuator.

The invention also relates to a watch including at least one such microactuator and/or at least one such printed circuit.

The invention relates to the field of micromechanical actuation systems, in particular for the field of horology.

BACKGROUND OF THE INVENTION

Conventional solenoid actuators are often poorly adapted to micromechanics, and particularly to horological construction. Indeed, they must meet the actuation and return constraints, as well as the very small dimensions required by the applications particularly horological.

The use of return springs is detrimental to the overall size of the microactuator, and does not guarantee an optimum resistance over time.

SUMMARY OF THE INVENTION

The aim is to develop a microactuator capable of applying a controlled mechanical braking force, in particular for micromechanical and particularly horological applications.

A particularly interesting application relates to the braking, which, in micromechanics and particularly in horology, requires an extremely short reaction time, as well as also an extremely short rest position return time.

Therefore, this involves improving a conventional solenoid actuator, so as to meet the actuation and return time constraints, as well as the very small dimensions required particularly by horological applications.

To this end, the invention relates to a magnetic microactuator according to claim 1. The invention also relates to a printed circuit including at least one such microactuator.

The invention also relates to a watch including at least one such microactuator and/or at least one such printed circuit.

SUMMARY DESCRIPTION OF THE DRAWINGS

Other features and advantages of the invention will become apparent upon reading the following detailed description, with reference to the appended drawings, where:

FIG. 1 shows, schematically and in perspective view a microactuator according to the invention, including a block structure, here non-limitingly consisting of a front case and a rear case, which surrounds a coil forming a stator, wherein a sliding block is moveable, which includes a permanent magnet and an arbor, the microactuator also includes a first ferromagnetic restoration element, here in the particular form of a soft ferromagnetic ring, attached to the rear of the rear case, on the side opposite to the front case that includes an opening through which the sliding block may protrude;

Figure 3:
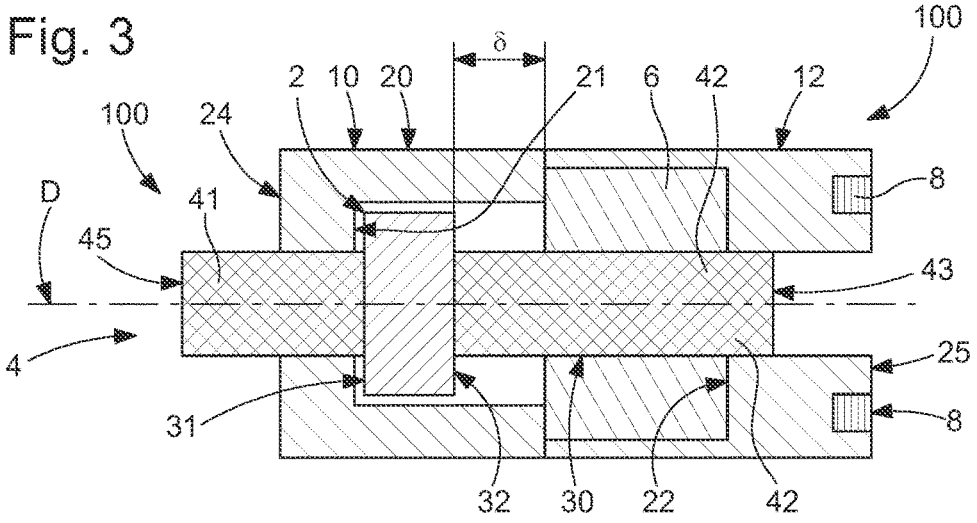
FIG. 3 shows, schematically and in sectional view along the plane P passing through the axis AA of FIG. 1, the microactuator of FIG. 1, in a first variant where the sliding block includes a front arbor and a rear arbor that are non-magnetic or soft ferromagnetic, and is in actuated position.
Figure 5:
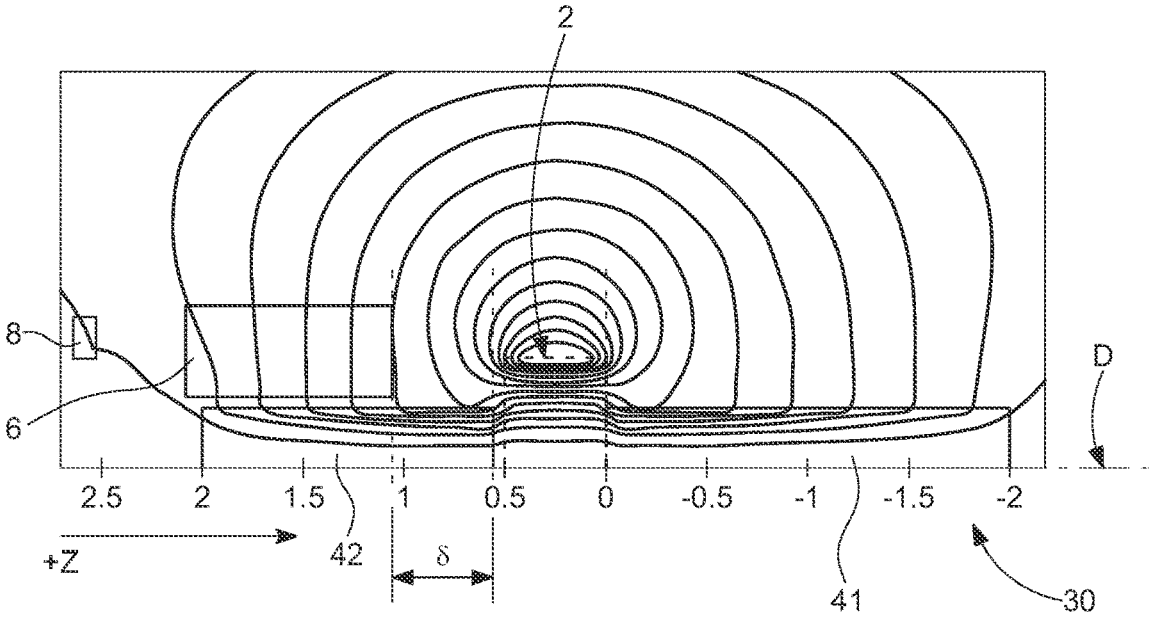
Figure 6:
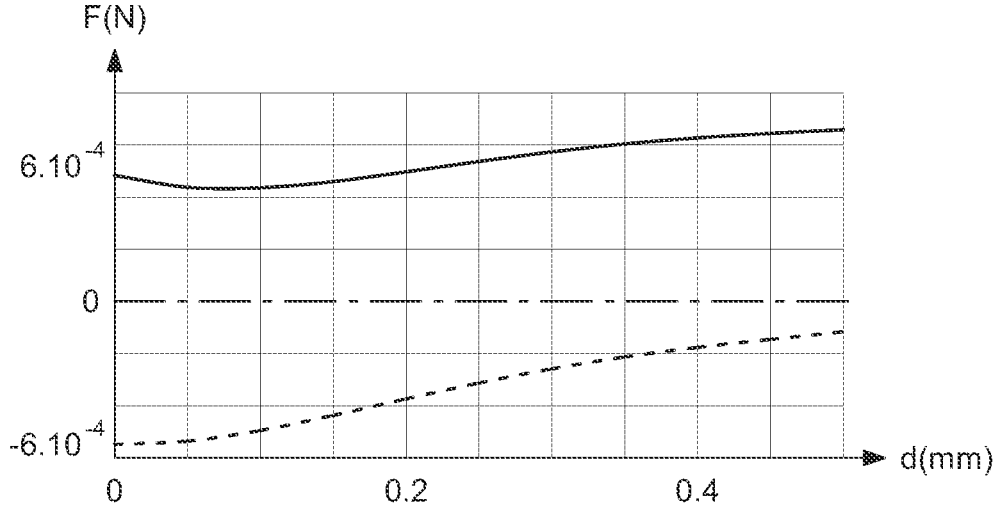
Figure 7:
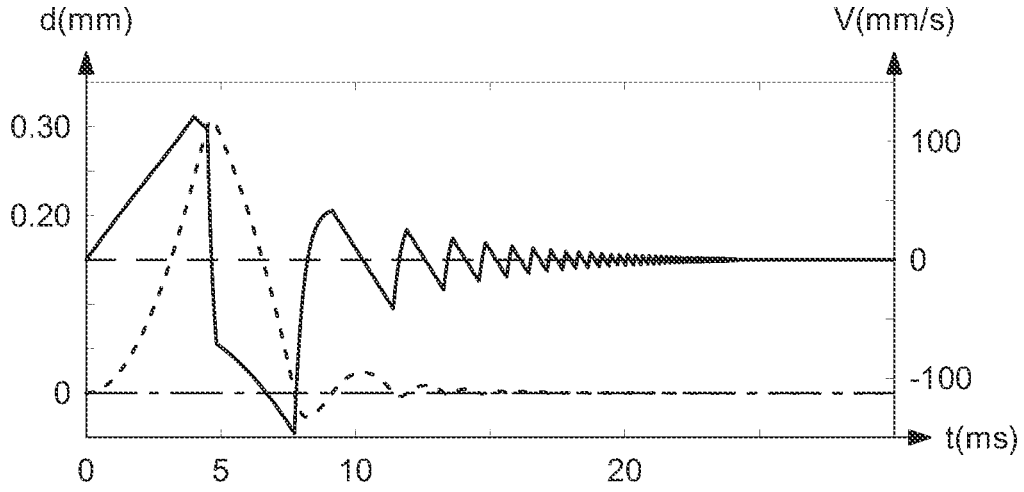
Figure 8:
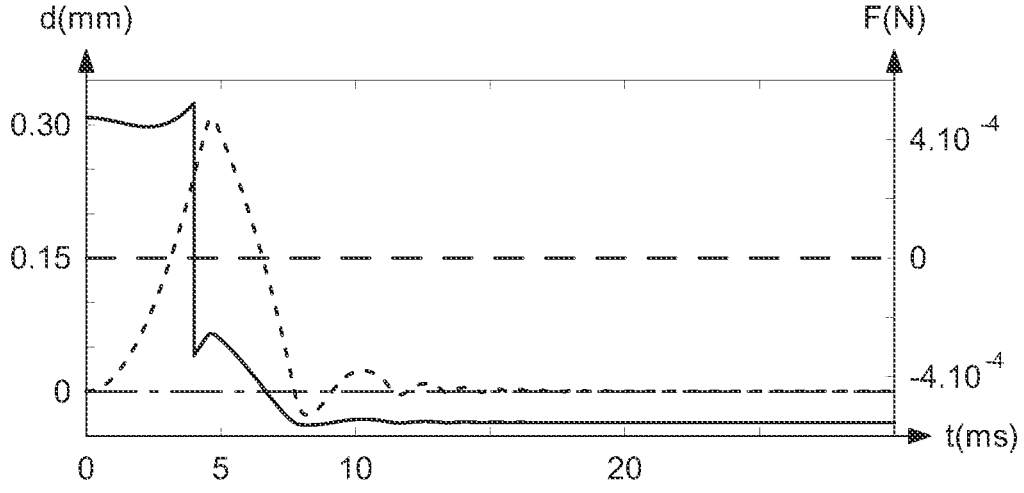
Figure 9:
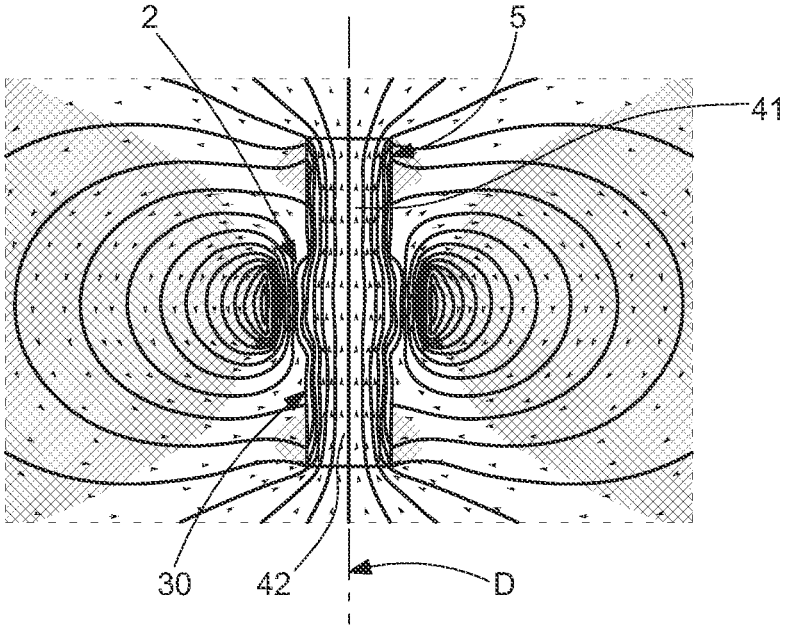
Figure 10:
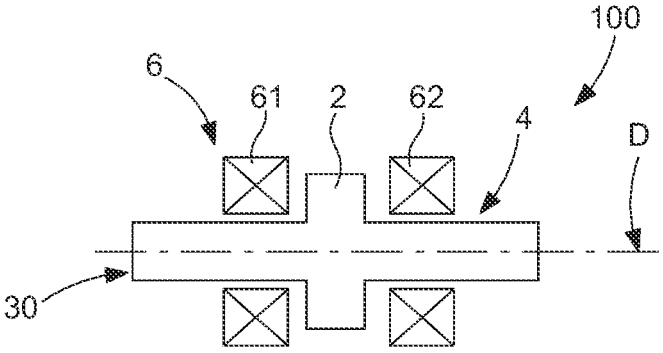
Figure 11:
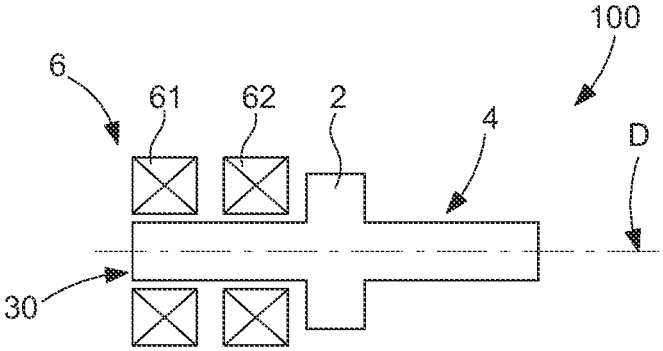
Figure 12:
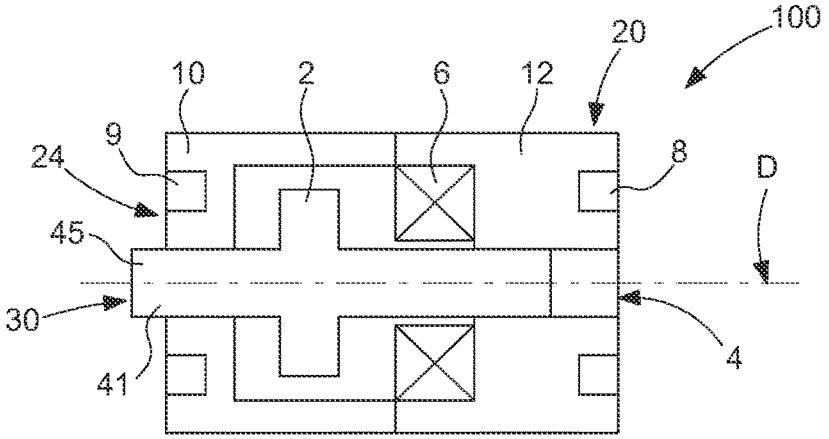
Figure 13:
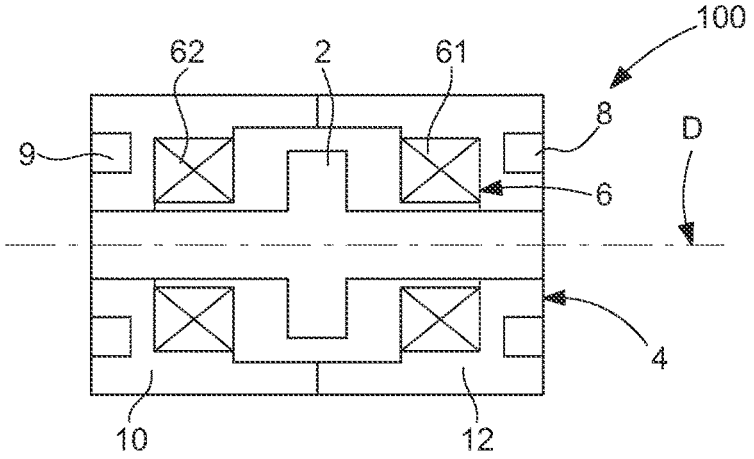
Figure 14:
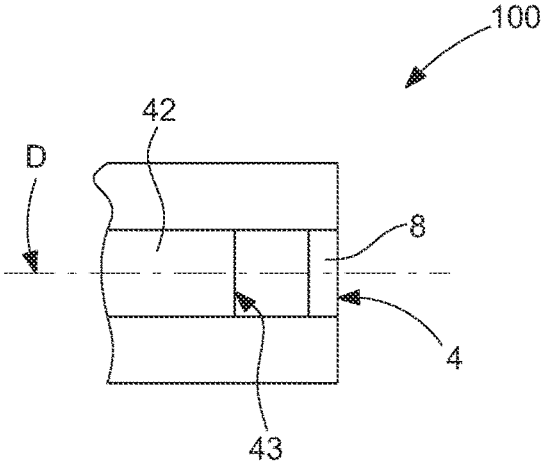
Figure 15:
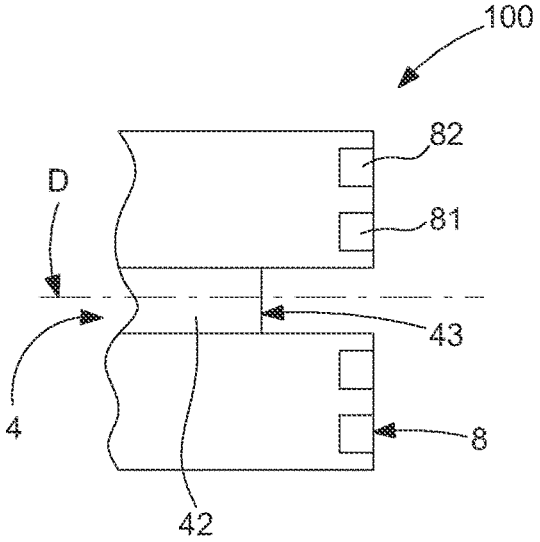
Figure 16:
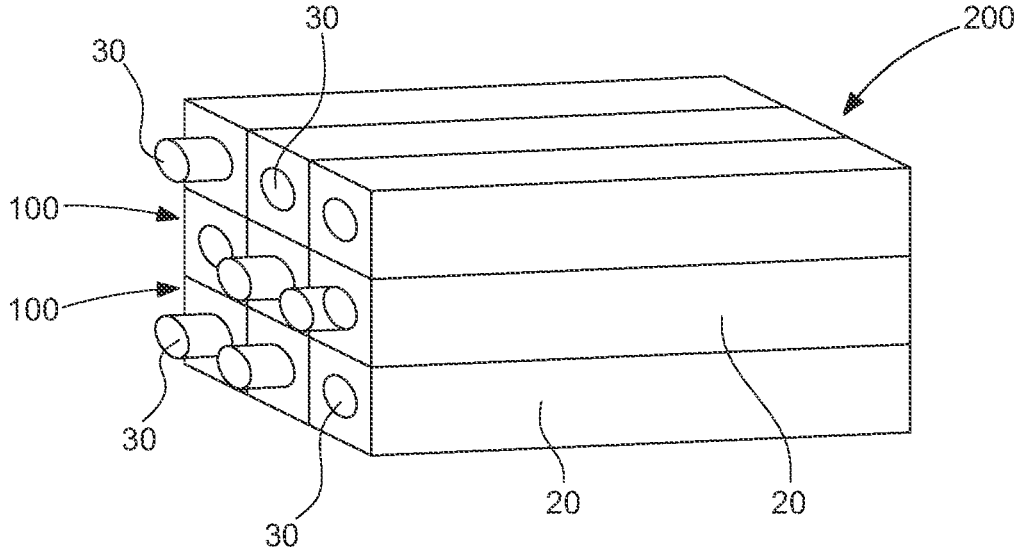
Figure 17:
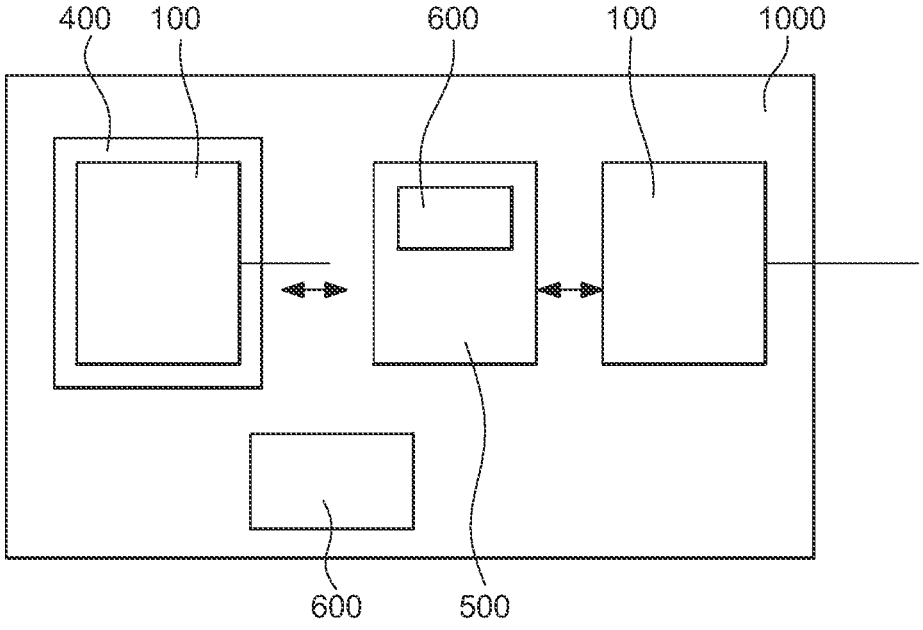

FIG. 5 is a field diagram from a simulation by finite elements, of the magnetic field for the microactuator of FIG. 3; the field lines of the permanent magnet are guided through the front arbor and the rear arbor of the sliding block; the powered coil drives the sliding block, including the front arbor, the rear arbor, and the magnet, in a positive Z direction; when the current in the coil is switched off, the ferromagnetic restoration element, particularly the soft ferromagnetic ring, produces a force in the opposite direction, which acts on the sliding block and brings it back to its initial position; the movement path is indicated by dashed lines;

FIG. 6 is a diagram illustrating, for the microactuator of FIG. 3, the variation of the force, shown in ordinate, acting on the sliding block when it is moved along the Z axis, in the direction AA, depending on the movement D shown in abscissa; the continuous line illustrates the variation of the positive force exerted by the coil when it is traversed by a current; the discontinuous line illustrates the variation of the return force imposed by the ferromagnetic restoration element;

FIG. 7 is a diagram illustrating, for the microactuator of FIG. 3, and for the force profile illustrated by FIG. 6, on the one hand in dashed line the variation of the movement of the sliding block, along the Z axis, in the direction AA, as a function of time t shown in abscissa, and on the other hand in continuous line the variation of the speed of the sliding block as a function of time t;

FIG. 8 is another diagram illustrating, for the microactuator of FIG. 3, and for the force profile illustrated by FIG. 6, on the one hand in dashed line the variation of the movement of the sliding block, along the Z axis, in the direction AA, as a function of time t shown in abscissa, and on the other hand in continuous line the variation of the force as a function of time t;

FIG. 9 is, in a similar manner to FIG. 5, a field diagram from a simulation by finite elements, of the magnetic field generated by a permanent toroidal magnet integral with the arbor, which includes at its ends permanent magnetic extensions; this simulation by finite elements concerns the sliding block alone, and does not include the coil or the rear ferromagnetic ring;

FIG. 10 shows, schematically, partially, and in sectional view passing through the axis of the sliding block, a sliding block surrounded by two coils, which, according to their power supply, make it possible to establish around the sliding block magnetic fields of opposite direction or of the same direction;

FIG. 11 shows, schematically, partially and in sectional view passing through the axis of the sliding block, a sliding block on only one side of which are arranged two coils, in an instantaneous power supply situation where these two coils create magnetic fields of additional effect, and of the same direction;

FIG. 12 shows, schematically, partially and in sectional view passing through the axis of the sliding block, in a similar manner to FIG. 3, a microactuator including a second ferromagnetic restoration element, in front portion of the structure, opposite the first ferromagnetic restoration element, and which is arranged to cooperate with the front end of the front arbor for its return;

FIG. 13 shows, in a similar manner to FIG. 12, a microactuator of substantially symmetrical construction, including a coil on each side of the permanent magnet that the sliding block supports;

FIG. 14 is a detail of the rear portion of a microactuator according to the invention, wherein the first ferromagnetic restoration element is a solid element;

FIG. 15 is a detail of the rear portion of a microactuator according to the invention, wherein the first ferromagnetic restoration element includes two ferromagnetic rings of different and substantially coplanar diameters;

FIG. 16 shows, schematically and in perspective view a microactuator according to the invention, including a juxtaposition of structures each containing a sliding block and the associated coil or coils, in an arrangement where the protrusion of various sliding blocks corresponds to a matrix coding;

FIG. 17 is a block diagram showing a micromechanism, particularly a watch, including a first microactuator according to the invention, forming part of a printed circuit, and of which the sliding block is arranged to actuate a component of another mechanism such as a horological movement, and a second microactuator according to the invention the sliding block of which is arranged to stimulate the epidermis of a user by protruding from the case of this micromechanism.

DETAILED DESCRIPTION OF PREFERRED EMBODIMENTS

The present invention describes a linear solenoid electromagnetic microactuator, or plunger microactuator, which uses a magnetic element for retracting the armature, also known as plunger core, and here called the sliding block. The aim is to produce a miniature mechanical braking element with the least possible parts and without mechanical spring elements.

Solenoid actuators are well known in the field of general mechanical engineering, particularly for the control of mechanisms. Most include a return spring of the sliding block, which limits their performances in particular as regards the duration of an operating cycle. They are difficult to miniaturise, and are not used for personal equipment.

The aim is to develop a microactuator capable of applying a controlled mechanical braking force, in particular for micromechanical and particularly horological applications.

A particularly interesting application relates to the braking, which, in micromechanics and particularly in horology, requires an extremely short reaction time, as well as also an extremely short rest position return time.

Therefore, this involves improving a conventional solenoid actuator, so as to meet the actuation and return time constraints, as well as the very small dimensions required particularly by horological applications.

Figure 1:
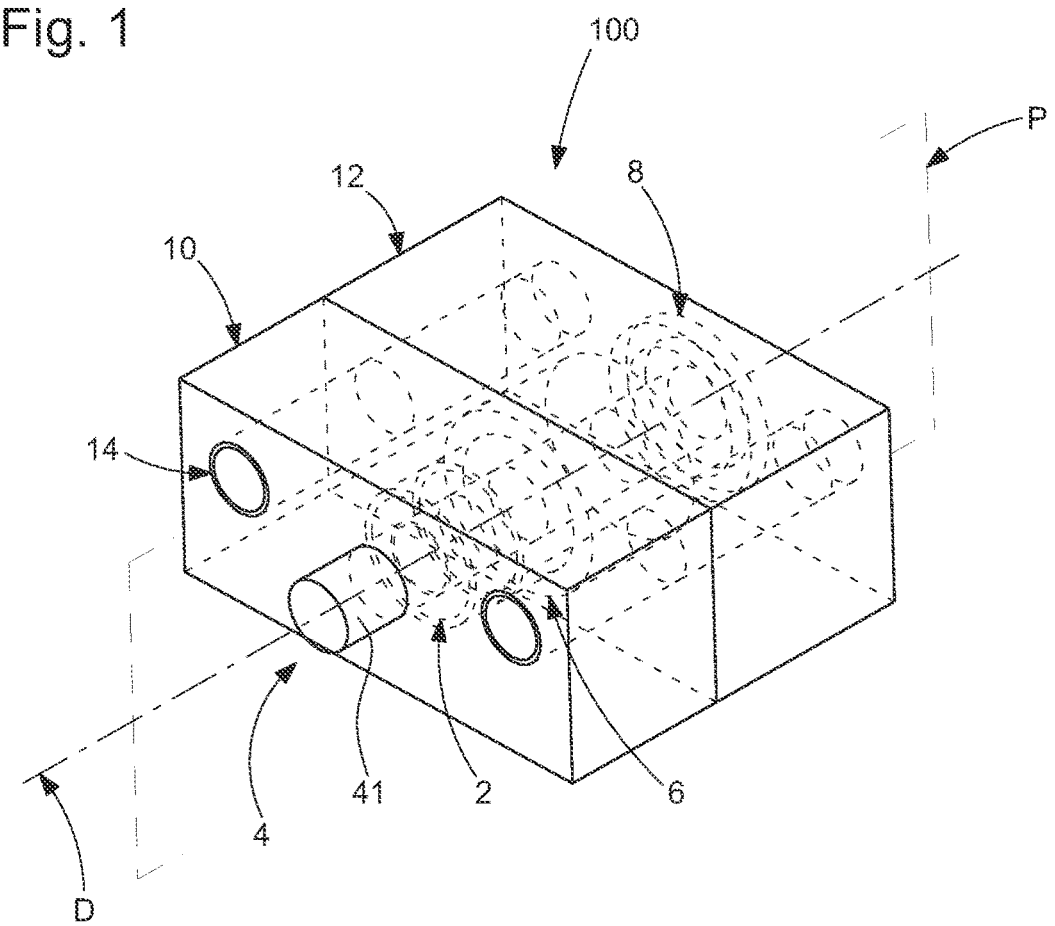
Figure 2:
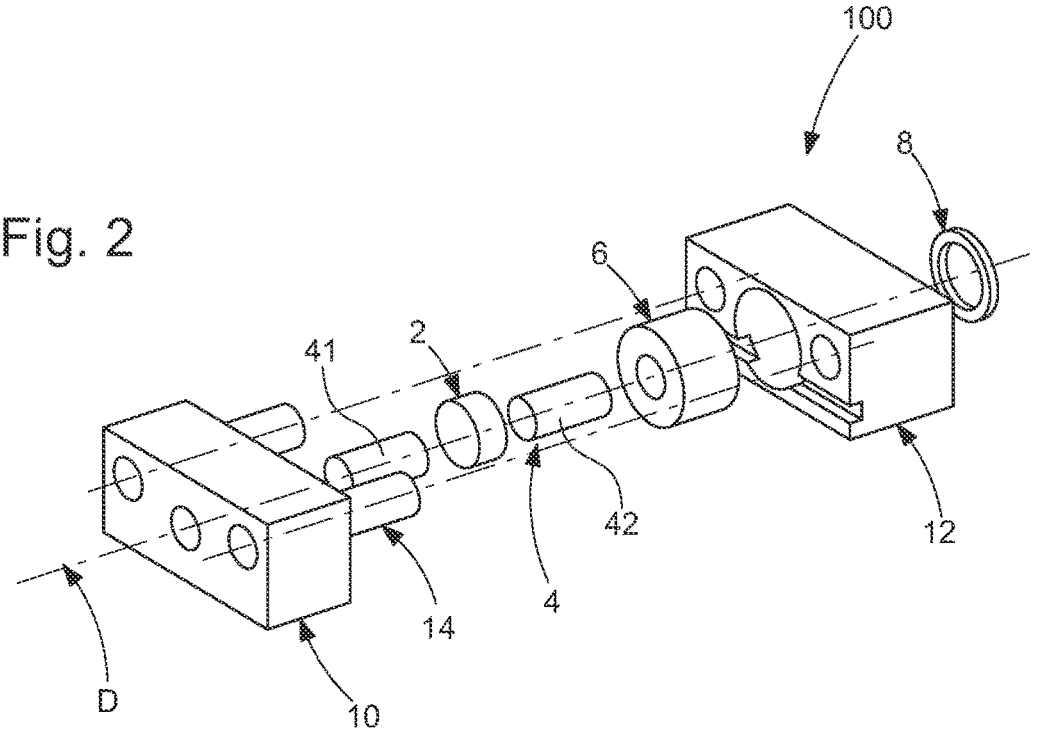
FIG. 2 shows, schematically and in expanded perspective view, the microactuator of FIG. 1.

The microactuator device 100 according to the invention is illustrated by FIGS. 1 and 2. It forms a block structure, here non-limitingly consisting of a front case 10 and of a rear case 12. This rear case 12 surrounds a coil 6, which forms the stator, and a sliding block, which includes at least one permanent magnet 2 and an arbor 4. This arbor 4 may be one-piece, or divided into a plurality of aligned portions, for example a front arbor 41 and a rear arbor 42 on either side of the permanent magnet 2 such as seen in FIG. 3. A first ferromagnetic restoration element 8, particularly but non-limitingly to a soft ferromagnetic ring, is attached to the rear of the rear case 12, on the side opposite to the front case 10. The microactuator 100 device assembly here is held assembled, in a non-limiting way, by two pins 14.

The microactuator 100 operates in a similar manner to a solenoid actuator. When an electric current is applied to the coil 6, a force is generated that pushes back the magnet 2 and pushes the arbor 4 forwards, in a positive Z direction, towards the front case 10. The maximal movement is determined at the end of travel by an end-of-travel abutment, for example the contact of the magnet 2 with the front case 10. If the current is inversed, the sliding block is retracted to the initial position defined by the point of contact between the sliding block and the stator (coil 6).

In certain applications, it is advantageous to apply a current in only one direction (single-pole drive). In this case, two options for returning the sliding block may be envisaged: for the general case where the microactuator 100 is intended to operate in a plurality of orientations, as in the case of a watch, it is possible to use at least one first ferromagnetic element 8, shown by a ring on FIGS. 1 to 4; this ferromagnetic element 8 may also be a block or a disk. In a very particular case, particularly static, where the microactuator 100 is positioned such that the sliding block 30 always moves upwards in a vertical direction, the necessary return force may be provided by the weight of the sliding block 30 which is brought back downwards by the gravitational field. This layout is only used rarely for static installations, such as clocks. In the general case, a return force must be generated to ensure the recoil of the sliding block to a rest position.

Figure 4:
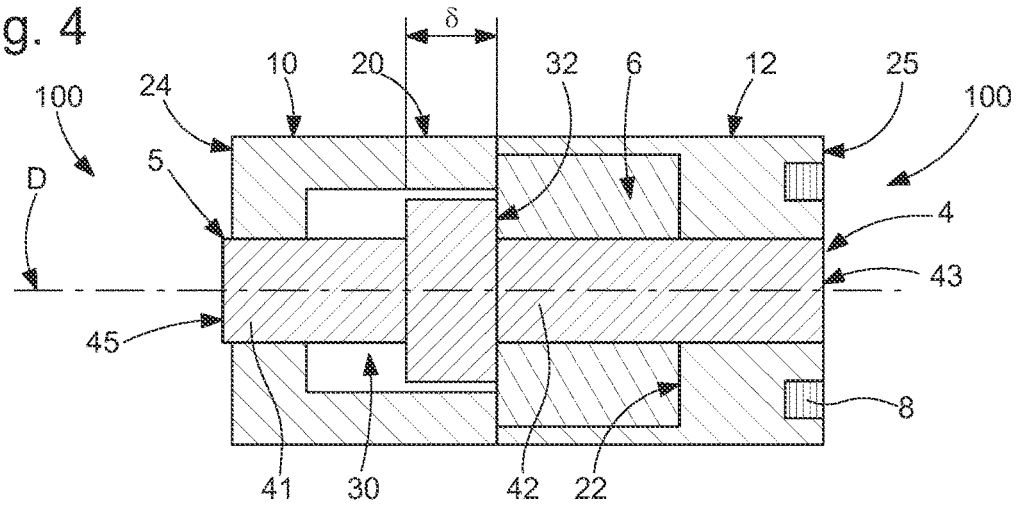
FIG. 4 shows, in a similar manner to FIG. 3, a second variant where the sliding block includes an arbor integral with a permanent magnet, and is in retracted position.

FIGS. 3 and 4 are cross sections of such microactuators 100 of different constitution, FIG. 3 illustrates the deployed (actuated) state of a sliding block 30 including a front arbor 41 and a rear arbor 42 both ferromagnetic, and FIG. 4 illustrates the retracted (stop) position of a sliding block 30 with a single one-piece arbor 4 joining the front arbor 41 and the rear arbor 42 and forming a permanent magnet.

In a variant such as that of FIG. 3 with a front arbor 41 and a rear arbor 42, it is essential that the rear arbor 42 is ferromagnetic in order to guarantee the necessary actuation and retraction forces. The front arbor 41 may for its part be ferromagnetic or non-magnetic. The front arbor 41 is more particularly intended to establish a physical contact with a target object, generally placed at least 0.5 mm from the microactuator 100.

This target object may consist of an element of a mechanism, particularly of a display mechanism, or of an oscillator, for example a balance, or even in the epidermis of a user for a haptic retroaction device, etc.

The range of movement, and therefore the position of the target, may naturally be adjusted depending on the application. It is necessary to make sure that, even with a longer travel, the actuation and return forces are adjusted correctly.

In a variant such as that of FIG. 4, the arbor 4 and the magnet 2 constitute a one-piece element. Again, the front portion forming the front arbor 41 of the arbor 4 may be non-magnetic, but it is advantageous that the rear portion forming the rear arbor 42 of the arbor 4 is made of magnetised material.

FIG. 5 illustrates the aspect of the magnetic field lines for the variant with a front arbor 41 and a rear arbor 42 that are soft ferromagnetic of the microactuator 100 of FIG. 3, with a cylindrical magnet 2 and a first annular ferromagnetic restoration element 8. This FIG. 5 is the result of a simulation by finite elements with radial symmetry. The rear arbor 42 guides the field lines of the magnet 2 towards the coil 6 and towards the first restoration element 8. The field lines of the permanent magnet 2 are guided through the front arbor 41 and the rear arbor 42. The coil 6 drives the sliding block 30 in the positive Z direction. If the current in the coil is switched off, the first ferromagnetic restoration element 8, particularly a soft ferromagnetic ring, produces a force in the opposite direction, which acts on the sliding block 30 and brings it back to its initial position. The movement path 6 is indicated by dashed lines; in this example the movement path is 0.5 mm.

The simulation by finite elements is used to obtain the force depending on the movement for the cases of dead coil 6 (0 V) and live coil 6 (2.5 V). The forces calculated are illustrated in the graph of FIG. 6. This FIG. 6 illustrates, for the microactuator of FIG. 3, the variation of the force, shown in ordinate, acting on the sliding block 30 when it is moved along the Z axis, in the direction AA, depending on the movement D shown in abscissa; the continuous line illustrates the variation of the positive force exerted by the coil 6 when it is traversed by a current; the discontinuous line illustrates the variation of the return force imposed by the ferromagnetic ring 8.

When the current is switched off, according to the curve in dashed line, the force is negative (retraction) and decreases when the sliding block 30 advances. It is important to note that even at the maximum extension, the force remains both sufficient to restore and retract the sliding block 30, and in this configuration is in the order of less than 0.1 mN. The necessary force is defined by the static friction between the sliding block 30 and the stator, defined by the contact points between the arbors and the casing such as they are described in detail below, and the gravitational force. The force profile for the on state, according to the curve in solid line, is positive, close to 0.5 mN. The switching force remains high and increases even more than 20% when the sliding block 30 slides forwards. This is the result of the presence, at the rear, of the soft ferromagnetic rear arbor 42, which ensures that a significant field and a significant field gradient, generated by the magnet 2, combine with the coil 6.

To obtain the dynamic from the forces calculated, the differential equation of such a system is integrated over the desired time scale. The results are illustrated in FIGS. 7 and 8.

The outlines are generated for a sliding block 30 of mass 0.015 g and an actuation impulse of 2.5 V for 4 ms, and correspond to the force profile illustrated by FIG. 6 commented on above. The maximum movement is fixed at 0.3 mm. This corresponds to an impact with an object by the front arbor 41, because the device itself has a maximum possible movement of 6=0.5 mm. As can be seen in FIG. 7, during the impact, there is a bounce after a small indent. The graphs indicate that the arbor 4 reaches its target after approximately 5 ms at a speed of 120 mm/s. The impact speed and the mass of the wheel set define the contact force, and the bounce defines an amount of movement. When the power supply of the coil 6 is stopped, even before the impact, the sliding block 30 returns to rest position in 5 ms. The return is ensured by the ferromagnetic ring 8, but also by the bounce, which may occur during the contact. The bounce is beneficial because it prevents the static friction, which may prevent the return of the sliding block 30.

FIG. 8 illustrates the movement and the force as a function of time. It can be seen clearly that once the actuation current of the coil 6 is switched off, the sliding block 30 starts to slow down because the force is negative. However, the point of impact is still reached. As there is a return force, the sliding block 30 returns to its starting position and optionally bounces a plurality of times depending on the damping at the point of contact. It is important that once stopped, the sliding block 30 is always securely held in place by the holding force exerted between the first ferromagnetic restoration element 8 and the sliding block 30. In this example, the holding force is approximately 0.5 mN, which is sufficient for maintaining a stable rest position even in the case of small vibrations and shocks.

FIG. 9 illustrates the magnetic field generated by a sliding block 30 entirely consisting of a permanent magnet, which includes permanent magnet extensions at both ends of the arbor. In this configuration, the arbors and the magnet are a single piece. The shading illustrates the positive (white) and negative (grey) $B_z$ areas. The field lines are very similar to those obtained with the ferromagnetic magnet-arbor composite sliding block 30.

The frictions are a limiting factor. The friction is a concern and the design must guarantee that the sliding of the arbor is effective. The friction should be minimised with a front arbor 41 and a rear arbor 42 that are perfectly aligned, held in position by the guide openings arranged in the cases 10 and 12. The friction between the materials constituting the arbor and the casing must be minimal by combining low friction coefficient materials or by adding lubrication coatings. Another more expensive solution, in accordance with horological traditions, involves matching stones (rubies) with a metal or ceramic arbor. A sufficient gap between the external diameter of the arbor and the internal diameter of the coil makes it possible to ensure that no contact is established between the arbor and the coil. The same applies regarding the gap between the arbor and the structure 20 of the microactuator, and between the external diameter of the magnet 2 and the cavity of the structure 20, so that the magnet 2 does not touch this structure 20. Naturally the calculation of each gap takes into account the entire range of operating temperatures of the apparatus.

The communication of information to a user generally involves the senses of vision and of hearing. The other conventional senses, smell, taste, and touch are on the other hand not used much. Haptic retroaction is currently an active field of research, with numerous variants.

Thus such a microactuator can be used for other applications, particularly in the field of retroaction haptics such as braille display, for tactile reading. Text codings for use by blind people through raised or indented characters was developed from the 14th century, by Zayn Ud Dîn Al Alidî, then in the 17th century by Francesco Lana de Terzi, and in the 18th century by Valentin Haüy, founder of the first school intended for blind people. The reading codes were improved in the 19th century by Charles Barbier de la Serre, for a military night-time writing or reading application, then by Louis Braille, whose code has become universal. Abraham-Louis Breguet produced, also in the 18th century, tact watches, including protruding pins, to make it possible to read the time in the dark.

The use of the sense of touch is currently an active field of research with numerous variants. In particular, there is a tendency to distinguish the skin perception at the epidermis, and the so-called haptic perception which concerns the combination of information provided by the nervous and muscular system of the individual with the information specific to this local skin perception, and which makes it possible to define more broadly an object, its movements, or its deformations. This haptic perception may also be combined with information provided by other senses of the individual, such as the perception of the temperature for example.

The microactuator according to the invention makes it possible to facilitate tactile reading, due to its small dimensions. In particular, it makes it possible to repeat the same signal with a particular frequency, indeed certain frequencies increase the stimulation for tactile applications, which also makes it possible to reduce the necessary impact force.

This microactuator can also be used in portable electronics, particularly for personal equipment, such as mechanical signalling system, for example to exert a pressure or a percussion on a limb in order to indicate a notification, an alarm, a telephone call or the arrival of a message, the exceedance of a particular threshold of a physical variable such as a radioactivity level, etc.

More particularly, and as illustrated by the figures, the invention thus relates to a magnetic microactuator 100 including at least one structure 20 containing at least one coil 6, 61, 62.

This coil 6, 61, 62, is arranged to exert, in a powered position, an axial thrust force on a sliding block 30, included in the microactuator 100, in an axial direction D in a first direction, up to a front end-of-travel position corresponding to an abutment bearing between a first bearing surface 21 of the structure 20 and a first abutment surface 31 of the sliding block 30.

In this front end-of-travel position, a front arbor 41, included in the sliding block 30, is protruding from a front face 24 of the structure 20.

In addition, when no coil 6, 61, 62, is powered the sliding block 30 is moveable in the axial direction D in a second direction opposite to the first direction, and is brought back by purely magnetic means to a rear end-of-travel position corresponding to an abutment bearing between a second bearing surface 22 of the structure 20 and a second abutment surface 32 of the sliding block 30.

According to the invention, the sliding block 30 includes at least one permanent magnet 2 joined with a rear arbor 42 aligned with the front arbor 41, or constituting at least one portion of the rear arbor 42. This at least one permanent magnet 2 generates a magnetic field of revolution around the axial direction D.

The rear arbor 42 is ferromagnetic or magnetised, and is arranged to guide the field lines of the magnetic field of revolution substantially in the axial direction D through this at least one coil 6, 61, 62, wherein circulates the sliding block 30, up to a rear end 43 of the rear arbor 42 that tends to cooperate by magnetic attraction with at least one first ferromagnetic restoration element 8.

This first ferromagnetic restoration element 8 is located in the vicinity of a rear face 25 of the structure 20, opposite the front face 24, and is arranged to cooperate with the magnetic field created by the permanent magnet 2, in order to bring the sliding block 30 back into its rear end-of-travel position when no coil 6, 61, 62, is powered.

More particularly, this at least one permanent magnet 2 is inserted between the front arbor 41 and a rear arbor 42 aligned with the front arbor 41.

More particularly, this at least one permanent magnet 2 is integral with the front arbor 41 and/or with the rear arbor 42.

More particularly, this at least one permanent magnet 2 includes the first abutment surface 31 of the sliding block 30 and/or the second abutment surface 32 of the sliding block 30. Even more particularly, this at least one permanent magnet 2 is protruding radially in relation to the front arbor 41 and/or to the rear arbor 42, and forms a flange supporting the first abutment surface 31 and/or the second abutment surface 32 of the sliding block 30.

More particularly, at least one first ferromagnetic restoration element 8 is of revolution around the axial direction D, and arranged to surround without contact the rear arbor 42 during its recoil to rear end-of-travel position.

More particularly, at least one first ferromagnetic restoration element 8 is of revolution around the axial direction D, and includes a frontal abutment surface, which is arranged to cooperate in abutment bearing with the rear arbor 42 during its recoil to rear end-of-travel position.

More particularly, at least one permanent magnet 2 is joined with the front arbor 41, or constitutes at least one portion of the front arbor 41, this at least one permanent magnet 2 generating a magnetic field of revolution around the axial direction D; this front arbor 41 is ferromagnetic or magnetised, and is arranged to guide the field lines of the magnetic field of revolution substantially in the axial direction D up to a front end 45 of the front arbor 41, which tends to cooperate by magnetic attraction with at least one second ferromagnetic restoration element 9, located in the vicinity of the front face 24 of the structure 20, in order to bring the sliding block 30 back into its rear end-of-travel position when no coil 6, 61, 62, is powered.

More particularly, the structure 20 includes at least one coil 6, 61, 62, connected to a two-way power supply.

More particularly, the structure 20 contains a plurality of coils 6, 61, 62. The mode for supplying power to these coils may make it possible to create magnetic fields in the same direction in the axial direction D, or to create magnetic fields in the opposite directions. Therefore the polarisation of the power supply is what determines the operating mode.

More particularly, at least two coils 6, 61, 62, are on either side of this at least one permanent magnet 2 of the sliding block 30.

More particularly, at least two coils 6, 61, 62, are on either side of all of the permanent magnets 2 included in the sliding block 30.

More particularly, the microactuator 100 includes a plurality of structures 20, which are joined by lateral faces and together form a block 200 with a matrix of sliding blocks 30 arranged to protrude from at least one first side of the block 200.

The travel of the sliding block 30 obviously depends on the dimensioning of the microactuator 100. For horological applications a travel in the order of a millimetre, particularly less than or equal to 1.0 mm, or also a fraction of a millimetre, is compatible with numerous applications.

More particularly, in a non-limiting implementation, corresponding to a production illustrated by the diagrams of the figures, the microactuator 100 is a watch component and includes at least one sliding block 30 with a travel less than or equal to 0.5 mm, and that is arranged to give a stop or adjustment impulse to another component included in a resonator, or an escapement mechanism, or a display mechanism, of a watch. From the advantageous horological applications the stop-seconds, the triggering or the stopping of a chronograph, the adjustment of the hand-setting, the adjustment of the calendar, the percussion of a timbre or of a gong in a striking-mechanism, etc., can be cited.

More particularly, the microactuator 100 is a component of a portable apparatus in contact with the skin of a user, and includes at least one sliding block 30 that is arranged to give at least one impulse per touch to give a warning signal to a user, and/or to transmit to the user a series of coded impulses.

More particularly, the microactuator 100 includes a plurality of sliding blocks 30 arranged to transmit to the user a series of impulses geometrically apart from one another.

The invention also relates to a printed circuit 400 including at least one such microactuator 100, in the form of a CMS component soldered on the plate of the printed circuit 400.

More particularly, the printed circuit 400 includes at least one circuit for powering a coil 6, 61, 62, of a microactuator 100. Even more particularly, the printed circuit 400 includes a power supply circuit for each coil 6, 61, 62, included in each microactuator 100 that the printed circuit 400 supports.

The invention also relates to a watch 1000 including at least one such microactuator 100, and/or at least one such printed circuit 400, and at least one energy source 600 for powering at least one coil 6, 61, 62, of a microactuator 100, and/or at least one movement 500 including at least one energy source 600 for powering at least one coil 6, 61, 62, of a microactuator 100.

In short, the invention describes an electromagnetic actuator that may be used to apply a braking force or a haptic retroaction. It may be set in motion by a single-pole power source since the return force is ensured thanks to a first ferromagnetic restoration element 8, such as particularly a ring made of soft ferromagnetic material.

The microactuator according to the invention thus has a plurality of advantages.

In the absence of actuation, the retracted position is stable and well defined. This guarantees that the braking is only applied during the "on" state, even in the case of mechanical disturbance such as vibrations or shocks.

The invention is advantageous in any configuration requiring an extremely rapid return of the plunger sliding block.

It is not necessary to apply a power to maintain the retracted position.

The geometry proposed is also intrinsically resistant to shocks because the sliding block 30 is highly stressed with a single dimension of freedom.

The device proposed is very compact and only includes a single moveable component. No spring is necessary.

The microactuator 100 may be manufactured as a CMS component for easy integration on a standard printed circuit, which guarantees very easy installation and a moderate cost.

The invention claimed is:

1. A magnetic microactuator (100) comprising:

at least one structure (20) containing at least one coil (6; 61; 62) arranged to exert, in a powered position, an axial thrust force on a sliding block (30), included in said microactuator (100), in an axial direction (D) in a first direction, up to a front end-of-travel position, corresponding to an abutment bearing between a first bearing surface (21) of said structure (20) and a first abutment surface (31) of said sliding block (30), and wherein in the front end-of-travel position, a front arbor (41), included in said sliding block (30), protrudes from a front face (24) of said structure (20), and, when said coil (6; 61; 62) is not powered said sliding block (30) is moveable in said axial direction (D) in a second direction opposite to the first direction, and is brought back by purely magnetic means to a rear end-of-travel position corresponding to an abutment bearing between a second bearing surface (22) of said structure (20) and a second abutment surface (32) of said sliding block (30), wherein said sliding block (30) includes at least one permanent magnet (2) joined with a rear arbor (42) aligned with said front arbor (41), or consisting of at least one portion of said rear arbor (42), said at least one permanent magnet (2) generating a magnetic field of revolution around said axial direction (D), which rear arbor (42) is ferromagnetic or magnetised and is arranged to guide the field lines of said magnetic field of revolution substantially in said axial direction (D) through said at least one coil (6; 61; 62), wherein said field lines circulate around said sliding block (30), up to a rear end (43) of said rear arbor (42) which tends to cooperate by magnetic attraction with at least one first ferromagnetic restoration element (8), located in the vicinity of a rear face (25) of said structure (20), opposite said front face (24), to bring said sliding block (30) back to said rear end-of-travel position when said coil (6; 61; 62) is not powered.

2. The microactuator (100) according to claim 1, wherein said at least one permanent magnet (2) is inserted between said front arbor (41) and a rear arbor (42) aligned with said front arbor (41).

3. The microactuator (100) according to claim 1, wherein said at least one permanent magnet (2) is integral with said front arbor (41) and/or with said rear arbor (42).

4. The microactuator (100) according to claim 1, wherein said at least one permanent magnet (2) includes said first abutment surface (31) of said sliding block (30) and/or said second abutment surface (32) of said sliding block (30).

5. The microactuator (100) according to claim 1, wherein said at least one permanent magnet (2) is protruding radially in relation to said front arbor (41) and/or to said rear arbor (42), and forms a flange supporting said first abutment surface (31) and/or said second abutment surface (32) of said sliding block (30).

6. The microactuator (100) according to claim 1, wherein said at least one first ferromagnetic restoration element (8) is arranged to surround without contact said rear arbor (42) during its recoil to rear end-of-travel position.

7. The microactuator (100) according to claim 1, wherein said at least one first ferromagnetic restoration element (8) includes a frontal abutment surface arranged to cooperate in abutment bearing with said rear arbor (42) during its recoil to rear end-of-travel position.

8. The microactuator (100) according to claim 1, wherein said at least one impermanent magnet (2) is joined with said front arbor (41), or constitutes at least one portion of said front arbor (41), said at least one permanent magnet (2) generating a magnetic field of revolution around said axial direction (D), which front arbor (41) is ferromagnetic or magnetised and is arranged to guide the field lines of said magnetic field of revolution substantially in said axial direction (D) up to a front end (45) of said front arbor (41), which tends to cooperate by magnetic attraction with at least one second ferromagnetic restoration element (9), located in the vicinity of said front face (24) of said structure (20), in order to bring back said sliding block (30) into its rear end-of-travel position when no said coil (6; 61; 62) is powered.

9. The microactuator (100) according to claim 1, wherein said at least one said coil (6; 61; 62) is connected to a two-way power supply.

10. The microactuator (100) according to claim 1, wherein said structure (20) contains a plurality of said coils (6; 61; 62) arranged to create magnetic fields of the same direction in the axial direction (D).

11. The microactuator (100) according to claim 10, wherein at least two said coils (6; 61; 62) are on either side of said at least one permanent magnet (2) of said sliding block (30).

12. The microactuator (100) according to claim 11, wherein at least two said coils (6; 61; 62) are on either side of all of the said permanent magnets (2) included in said sliding block (30).

13. The microactuator (100) according to claim 1, wherein said structure (20) contains a plurality of said coils (6; 61; 62) of which at least two are arranged to create magnetic fields of opposite direction in the axial direction (D).

14. The microactuator (100) according to claim 13, wherein at least two said coils (6; 61; 62) are on either side of said at least one permanent magnet (2) of said sliding block (30).

15. The microactuator (100) according to claim 14, wherein at least two said coils (6; 61; 62) are on either side of all of the said permanent magnets (2) included in said sliding block (30).

16. The microactuator (100) according to claim 1, wherein said microactuator (100) includes a plurality of said structures (20) joined by lateral faces and together forming a block (200) with a matrix of said sliding blocks (30) arranged to protrude from at least one first side of said block (200).

17. The microactuator (100) according to claim 16, wherein said microactuator (100) includes a plurality of said sliding blocks (30) arranged to transmit to said user a series of impulses geometrically apart from one another.

18. The microactuator (100) according to claim 1, wherein said microactuator (100) is a watch component and includes at least one said sliding block (30) with a travel less than or equal to 1.0 mm, arranged to give a stop or adjustment impulse to another component included in a resonator, or an escapement mechanism, or a display mechanism, of one said watch.

19. The microactuator (100) according to claim 1, wherein said microactuator (100) is a component of a portable device in contact with the skin of a user and includes at least one said sliding block (30) arranged to give at least one impulse per touch to give a warning signal to a user, and/or to transmit to said user a series of coded impulses.

20. A printed circuit (400) including at least one said microactuator (100) according to claim 1, in the form of CMS component soldered on the plate of said printed circuit (400).

21. The printed circuit (400) according to claim 20, wherein said printed circuit (400) includes at least one circuit for powering a-said coil (6; 61; 62) of a said microactuator (100).

22. The printed circuit (400) according to claim 21, wherein said printed circuit (400) includes a power supply circuit for each said coil (6; 61; 62) included in each said microactuator (100) that said printed circuit (400) supports.

23. A watch (1000) including at least one said microactuator (100) according to claim 1, and at least one energy source (600) for powering at least one said coil (6; 61; 62) of a said microactuator (100), and/or at least one movement (500) including at least one energy source (600) for powering at least one said coil (6; 61; 62) of a said microactuator (100).

* * * * *